US010822860B2

(12) United States Patent
Floe

(10) Patent No.: US 10,822,860 B2
(45) Date of Patent: Nov. 3, 2020

(54) ELECTRONICALLY CONTROLLED WINDOW

(71) Applicant: Wayne Floe, McGregor, MN (US)

(72) Inventor: Wayne Floe, McGregor, MN (US)

( * ) Notice: Subject to any disclaimer, the term of this patent is extended or adjusted under 35 U.S.C. 154(b) by 0 days.

(21) Appl. No.: 15/998,561

(22) Filed: Aug. 17, 2018

(65) Prior Publication Data

US 2019/0218845 A1 Jul. 18, 2019

Related U.S. Application Data

(60) Provisional application No. 62/546,420, filed on Aug. 16, 2017.

(51) Int. Cl.

| | |
|---|---|
| ***E05F 11/34*** | (2006.01) |
| ***E05F 15/697*** | (2015.01) |
| *E05D 15/16* | (2006.01) |
| *B63B 19/00* | (2006.01) |

(52) U.S. Cl.

CPC ..... *E05F 15/697* (2015.01); *B63B 19/00* (2013.01); *B63B 2019/0038* (2013.01); *E05D 15/165* (2013.01); *E05Y 2201/656* (2013.01); *E05Y 2900/514* (2013.01)

(58) Field of Classification Search

CPC ..... E05F 15/697; E05Y 2201/656; E05Y 2900/514; E05D 15/165; B63B 19/00; B63B 2019/0038

USPC ..... 49/360, 361, 362

See application file for complete search history.

(56) References Cited

U.S. PATENT DOCUMENTS

| | | | | |
|---|---|---|---|---|
| 1,198,138 | A * | 9/1916 | Lovell | E05F 17/00 49/98 |
| 1,348,275 | A * | 8/1920 | Fontquerni-Vila | E05F 15/665 49/136 |
| 5,301,734 | A * | 4/1994 | Opel | E05D 15/22 160/100 |
| 5,440,837 | A * | 8/1995 | Piltingsrud | E05D 15/22 49/139 |
| 5,502,925 | A * | 4/1996 | Gorrell | E05D 13/1207 49/139 |
| 5,605,013 | A * | 2/1997 | Hogston | E05F 15/673 49/31 |
| 5,964,173 | A * | 10/1999 | Erskine | B63B 19/00 114/176 |
| 9,797,182 | B2 * | 10/2017 | Raap | E06B 3/44 |
| 10,370,887 | B2 * | 8/2019 | Lange | E05D 13/1207 |
| 2001/0027621 | A1 * | 10/2001 | Davies | E05D 15/0604 49/360 |
| 2004/0244295 | A1 * | 12/2004 | Derham | E05F 15/41 49/362 |

(Continued)

*Primary Examiner* — Jerry E Redman

(57) ABSTRACT

An electronically powered window for a watercraft consists of a shuttle frame, a sliding mechanism, a window pane, and a bottom edge support groove. A first lateral support arm and a second lateral support arm of the shuttle frame along with the bottom edge support groove helps position the window pane within the shuttle frame. The sliding mechanism allows the user to position the window pane such that the window is in an open configuration or a closed configuration. To do so, a first lateral edge is slidably positioned along the first lateral support arm. Moreover, a second lateral edge is slidably positioned along the second lateral support arm.

9 Claims, 11 Drawing Sheets

(56) References Cited

U.S. PATENT DOCUMENTS

| | | | | |
|---|---|---|---|---|
| 2007/0011946 | A1* | 1/2007 | Mullen | E05F 15/665 49/325 |
| 2007/0234644 | A1* | 10/2007 | Jaeger | E05D 15/10 49/362 |
| 2013/0318875 | A1* | 12/2013 | Hansen | E05F 15/665 49/349 |
| 2014/0053488 | A1* | 2/2014 | Lenox | E06B 3/26303 52/404.1 |
| 2015/0247357 | A1* | 9/2015 | Danaud | E06B 3/4415 49/408 |
| 2016/0222709 | A1* | 8/2016 | Wynder | E05D 15/16 |
| 2017/0009507 | A1* | 1/2017 | Newman | E05F 15/673 |
| 2017/0130512 | A1* | 5/2017 | McKenna | E05D 13/14 |
| 2019/0218845 | A1* | 7/2019 | Floe | E05F 15/697 |
| 2019/0277077 | A1* | 9/2019 | Ben-Arie | E05D 15/165 |

* cited by examiner

ELECTRONICALLY CONTROLLED WINDOW

The current application claims a priority to the U.S. Provisional Patent application Ser. No. 62/546,420 filed on Aug. 16, 2017.

FIELD OF THE INVENTION

The present invention relates generally to electronically powered windows. More specifically, the present invention is an electronically powered window for a watercraft. By using the present invention, an individual can control the position of the window by simply controlling a switch.

BACKGROUND OF THE INVENTION

A boat operator undergoes different weather conditions when boating. Based upon the weather conditions, certain changes need to be made to the boat. As an example, during rainy and windy conditions, the windows of the boat need to be closed. In another instance, during the summer and warm weather conditions, the user may prefer the windows of the boat to be open. Even though existing windows and existing window controlling mechanisms are effective, there are certain drawbacks to these windows and window control mechanisms.

For instance, a majority of the windows on boats are manually controlled. Thus, the overall process of manually opening and manually closing windows can be time consuming and stressful. The lack of efficiency related to manually controlled windows can be disadvantageous during storms and other relatable harsh weather conditions.

The need to manually operate the windows limits the overall size of the window as well. In other words, a majority of the windows are designed to be small in size so that they can be easily controlled. The smaller sized windows limit the design improvements that can be incorporated into a boat. Thus, a method to control the windows on a boat with greater efficiency is clearly needed.

The objective of the present invention is to address the aforementioned issues. More specifically, the present invention introduces a method that can be used to control the windows on a boat with greater efficiency. Since the need to manually control the window is eliminated by the present invention, windows of different sizes can be incorporated into the design of the boat.

DETAIL DESCRIPTIONS OF THE INVENTION

All illustrations of the drawings are for the purpose of describing selected versions of the present invention and are not intended to limit the scope of the present invention.

The present invention introduces an electronically powered window. More specifically, the present invention is intended to be used on a boat so that the windows of the boat can be opened or closed by controlling a switch. Thus, the overall time for closing a window or opening a window is minimized. Furthermore, the effectiveness of the present invention allows boat designers to include windows of different sizes in the design of the boat.

Figure 1:
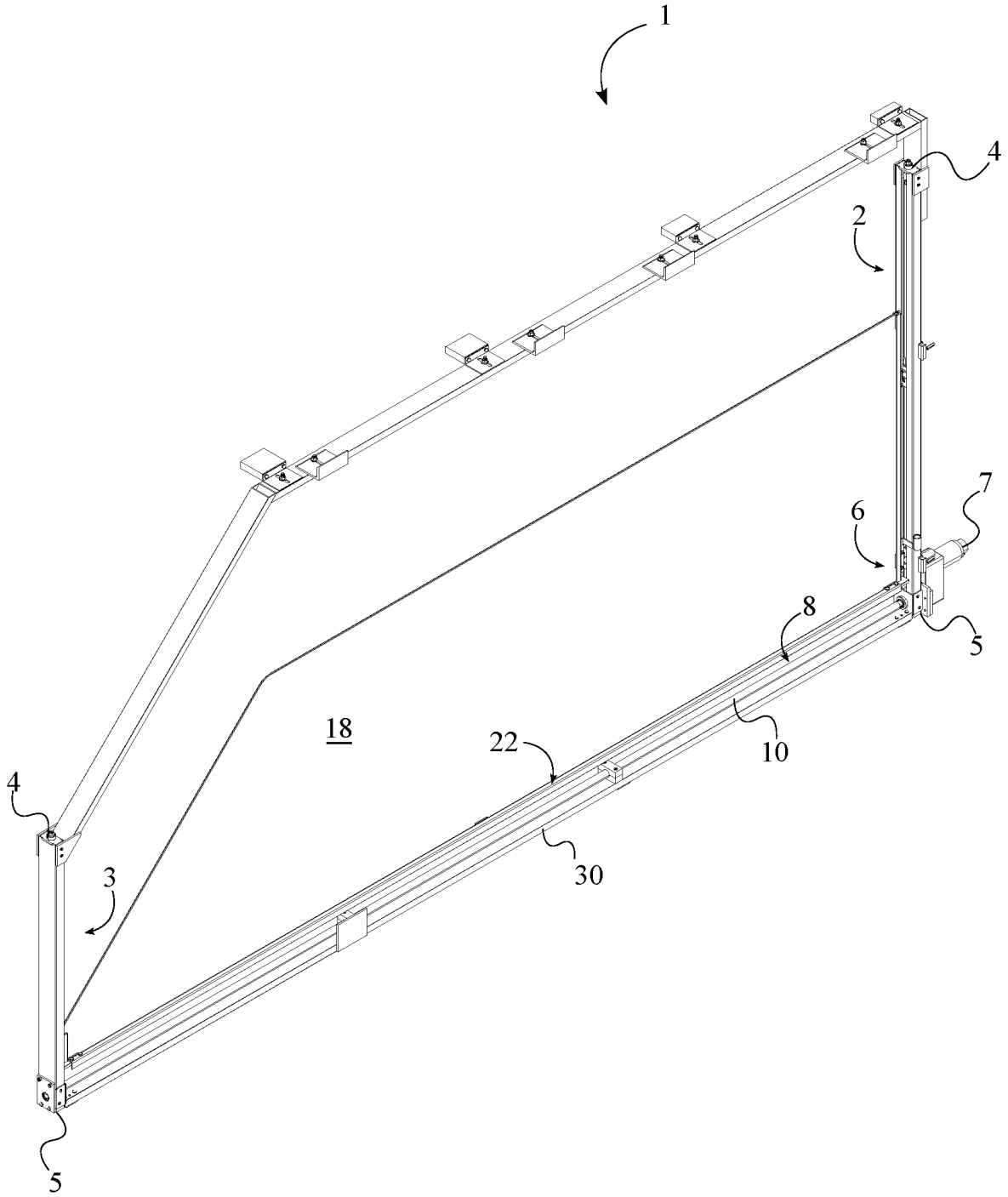
FIG. 1 is a perspective view of the present invention.
Figure 2:
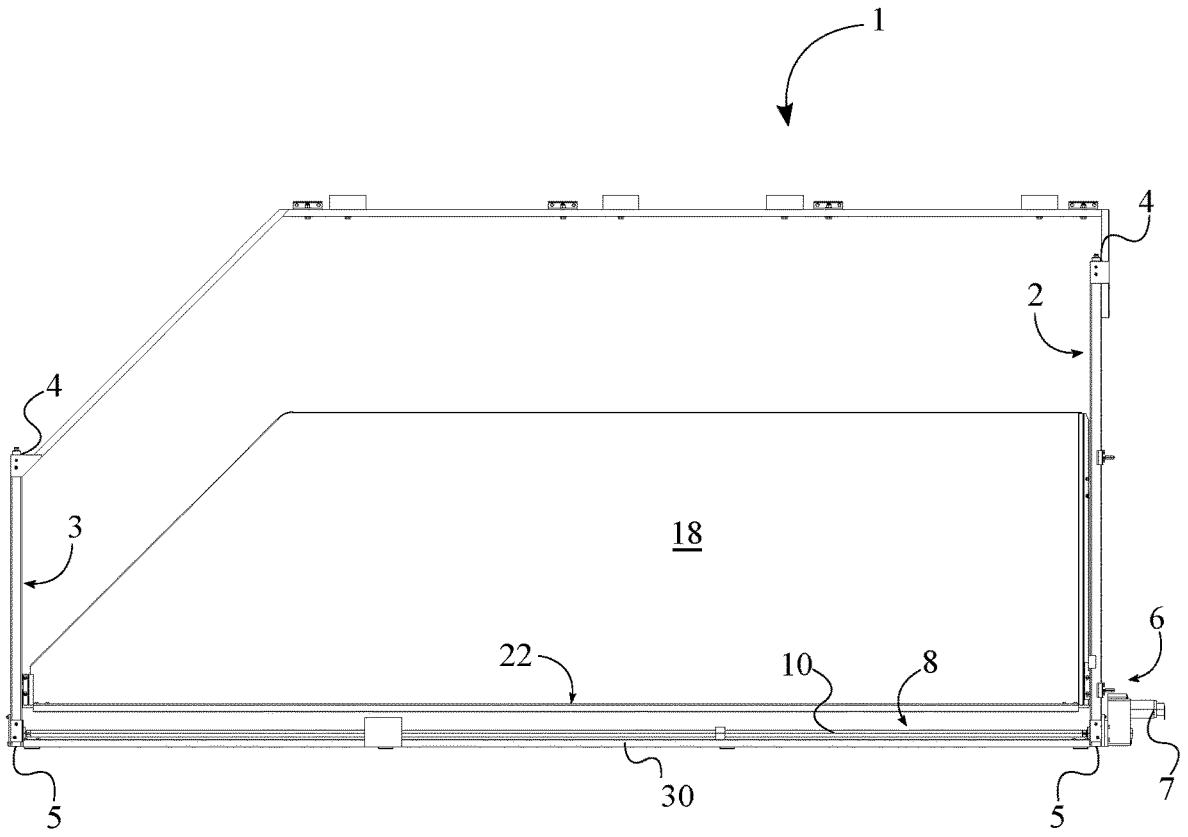
FIG. 2 is a side view of the present invention.

As seen in FIG. 1 and FIG. 2, to fulfill the intended functionalities, the present invention comprises a shuttle frame 1, a sliding mechanism 6, a window pane 18, and a bottom edge support groove 22. The shuttle frame 1 determines the overall size and shape of the window. Based upon the boat model and the location on the boat where the window pane 18 is being used, the size and shape of the shuttle frame 1 can vary. The sliding mechanism 6 is used to move the window pane 18 in a vertical direction so that the window can have an open configuration and a closed configuration. The bottom edge support groove 22 is positioned within the shuttle frame 1 and allows the window pane 18 to remain in an upright position. The window pane 18 is sized and shaped to be positioned within the shuttle frame 1. Therefore, the size and shape of the window pane 18 can vary in different embodiments of the present invention.

Figure 4:
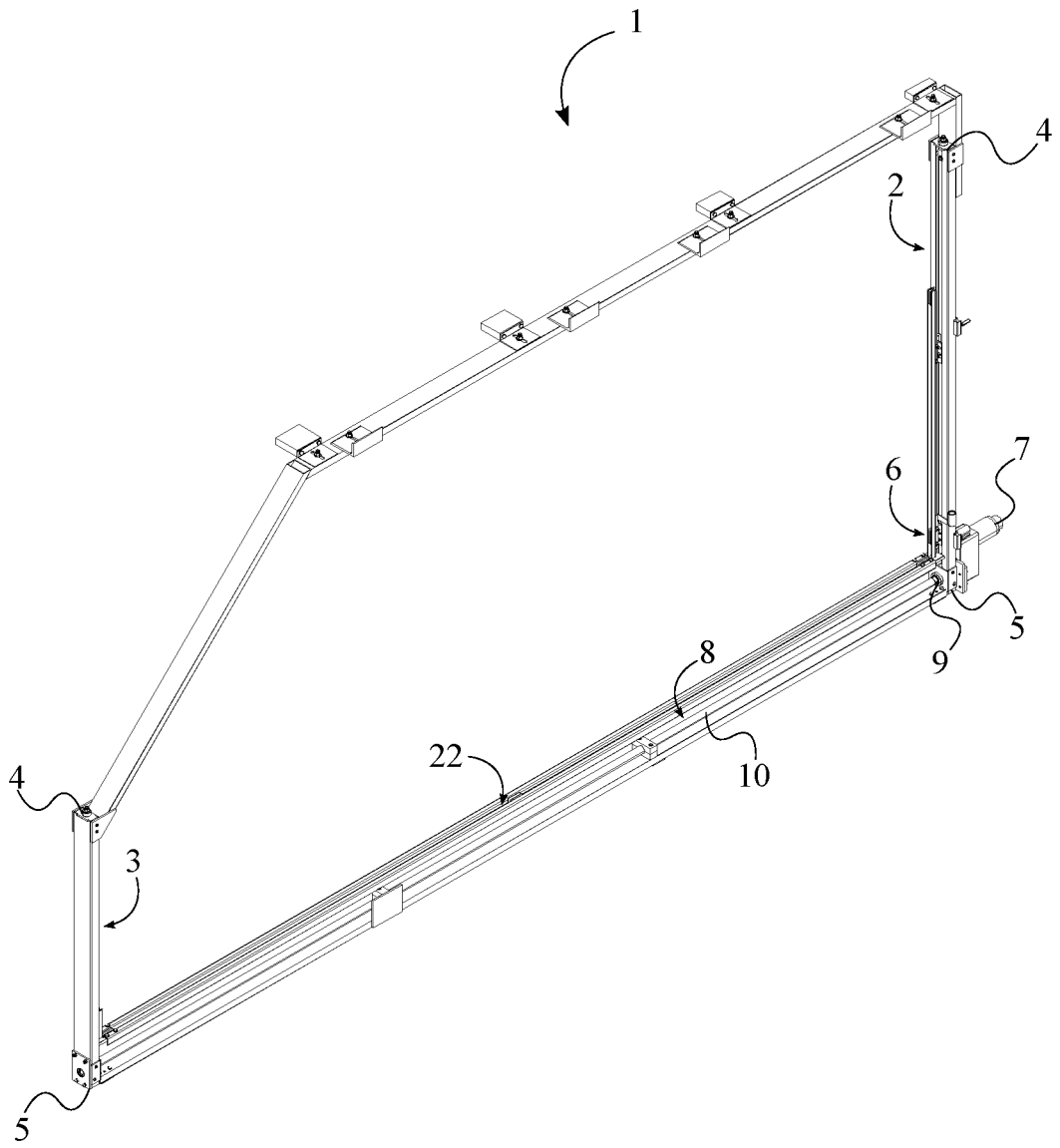
FIG. 4 is a perspective view of the shuttle frame.

As seen in FIG. 4, to allow the window pane 18 to slide along the shuttle frame 1 in a vertical direction, the shuttle frame 1 comprises a first lateral support arm 2 and a second lateral support arm 3 wherein the first lateral support arm 2 is positioned in parallel to the second lateral support arm 3. The bottom edge support groove 22 is positioned in between the first lateral support arm 2 and the second lateral support arm 3. Moreover, the bottom edge support groove 22 is positioned perpendicular to the first lateral support arm 2 and the second lateral support arm 3. The positioning of the bottom edge support groove 22 with reference to the first lateral support arm 2 and the second lateral support arm 3 ensures that the window pane 18 is appropriately positioned within the shuttle frame 1.

Figure 3:
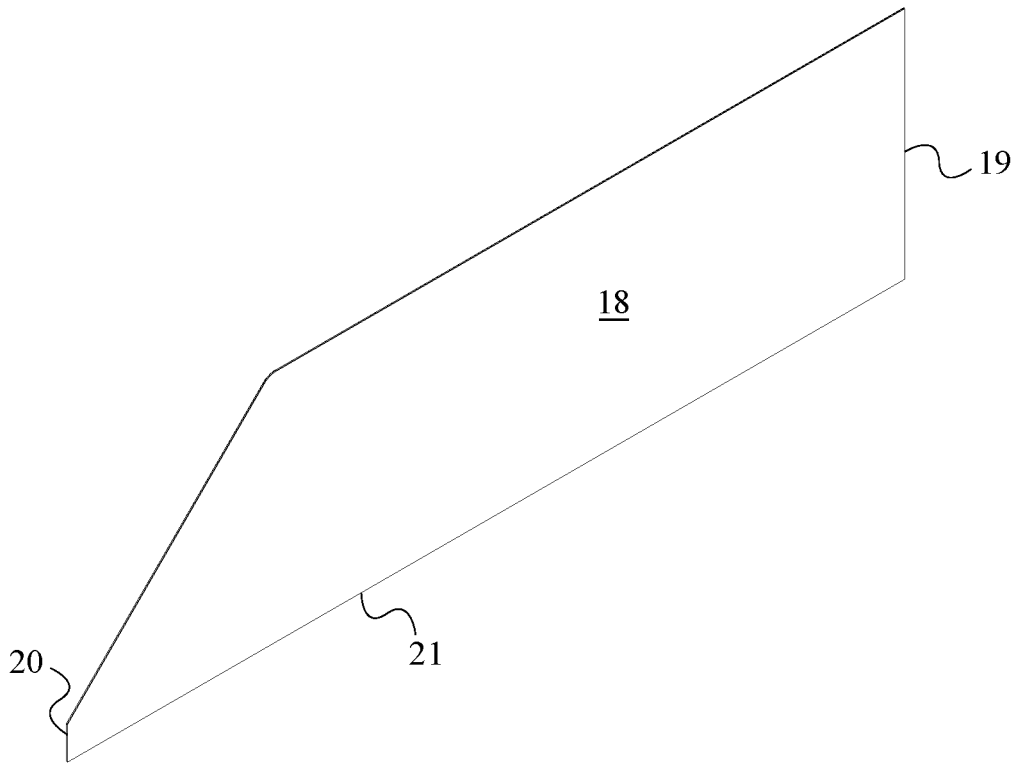
FIG. 3 is a perspective view of the window pane.

As seen in FIG. 3, to correspond with the first lateral support arm 2, the second lateral support arm 3, and the bottom edge support groove 22, the window pane 18 comprises a first lateral edge 19, a second lateral edge 20, and a bottom edge 21. In the preferred embodiment of the present invention, the first lateral edge 19 is terminally and perpendicularly connected to the bottom edge 21. On the other hand, the second lateral edge 20 is also terminally and perpendicularly connected to the bottom edge 21 opposite the first lateral edge 19 along the bottom edge 21, wherein the bottom edge 21 is positioned into the bottom edge support groove 22. The first lateral edge 19 is slidably positioned along the first lateral support arm 2 with the sliding mechanism 6. Similarly, the second lateral edge 20 is slidably positioned along the second lateral support arm 3 with the sliding mechanism 6.

Figure 9:
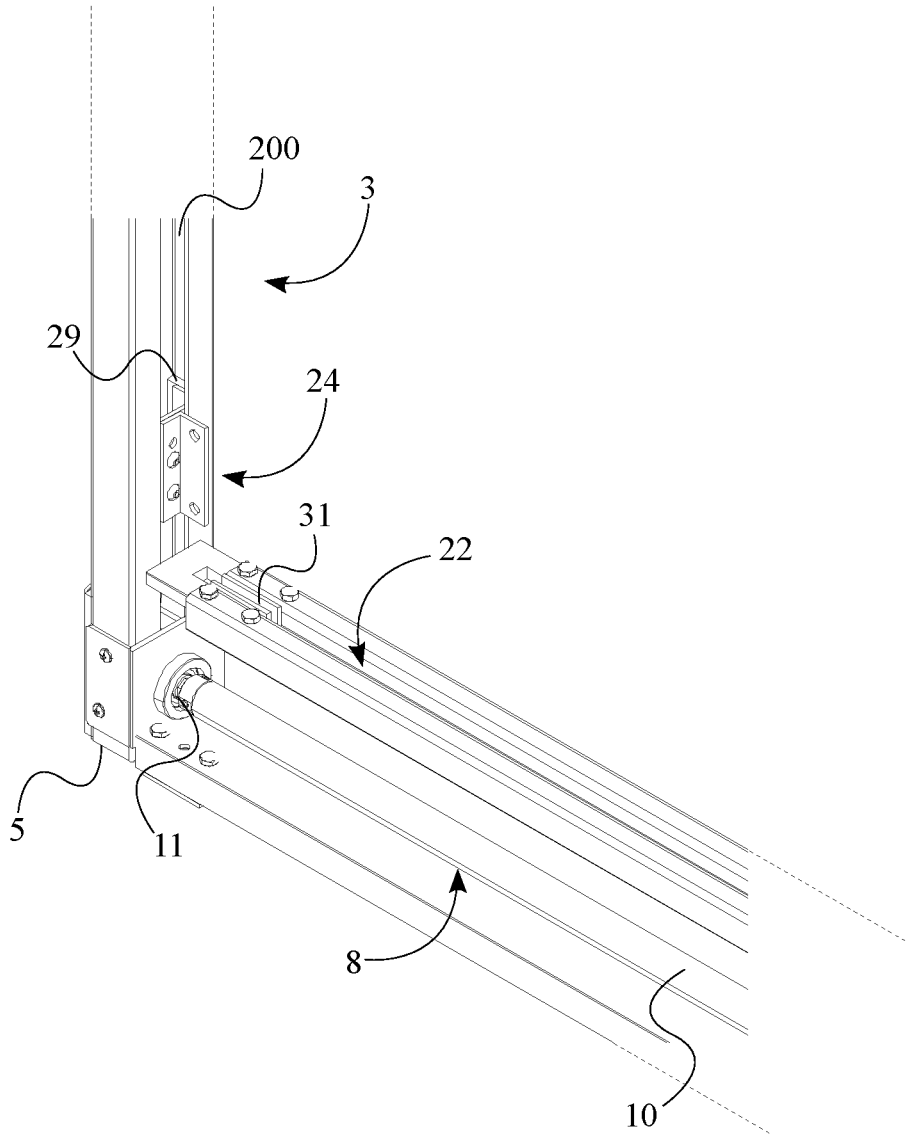
FIG. 9 is a perspective view of the second holding member positioned along the second lateral support arm.

When the bottom edge 21 is positioned within the bottom edge support groove 22, and if the window pane 18 is directly in contact with the bottom edge support groove 22, the materialistic properties of the bottom edge support groove 22 can damage the window pane 18. In other words, if the bottom edge support groove 22 is made of steel, the long-term contact between the window pane 18 and steel can damage the window pane 18. As seen in FIG. 9, to mitigate any damage that can occur to the window pane 18, the present invention comprises at least one bottom edge buffer barrier 31. The at least one bottom edge buffer barrier 31 is positioned along the bottom edge 21. Thus, when the bottom edge 21 is positioned in the bottom edge support groove 22, the at least one bottom edge buffer barrier 31 is compressed in between the bottom edge 21 and an internal surface of the bottom edge support groove 22.

Figure 10:
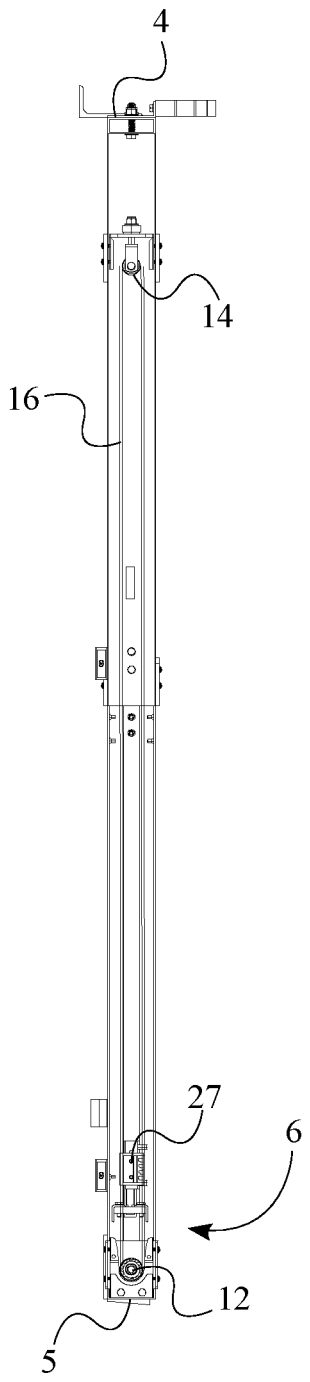
FIG. 10 is a side view of the sliding mechanism along the first lateral support arm.
Figure 11:
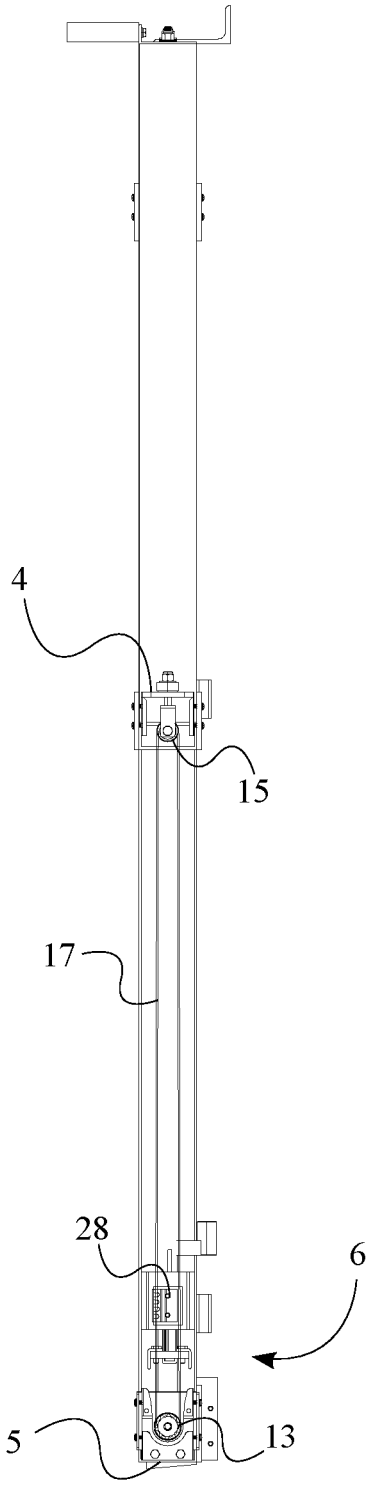
FIG. 11 is a side view of the sliding mechanism along the second lateral support arm.

The sliding mechanism 6 can vary in different embodiments of the present invention. As seen in FIG. 4, FIG. 10, and FIG. 11, in the preferred embodiment of the present invention, the sliding mechanism 6 comprises a gear motor 7, a rotating shaft 8, a first drive gear 12, a second drive gear 13, a first sprocket 14, a second sprocket 15, a first chain 16, and a second chain 17. The gear motor 7 is used to receive an input from the user. In other words, based upon the input received by the gear motor 7, the window pane 18 attains an open configuration or a closed configuration. To receive and transmit the user input, the gear motor 7 is mechanically coupled with the first drive gear 12 which is also connected to a first end 9 of the rotating shaft 8 opposite the gear motor 7. According to the rotational movement of the first drive gear 12, a shaft body 10 of the rotating shaft 8 transfers the rotational movement to a second end 11 of the rotating shaft 8. To do so, the shaft body 10 extends from the first end 9 to the second end 11. Thus, a second drive gear 13 connected at the second end 11 rotates in the rotational direction of the first drive gear 12. As an example, if the first drive gear 12 rotates in a clockwise direction as seen from a right view as in FIG. 10, the shaft body 10 of the rotating shaft 8 rotates in a clockwise direction, and the second drive gear 13 connected at the second end 11 of the rotating shaft 8 also rotates in a clockwise direction. Even though a gear drive sliding mechanism is used in the preferred embodiment of the present invention, in other embodiments of the present invention, a hydraulic sliding mechanism or other comparable sliding mechanism can be used.

As seen in FIG. 10, the first drive gear 12 is positioned adjacent a bottom end 5 of the first lateral support arm 2. For the window pane 18 to correspond to the rotational movement of the first drive gear 12, the first sprocket 14 is positioned adjacent a top end 4 of the first lateral support arm 2 opposite the first drive gear 12 across a body of the first lateral support arm 2. To transfer the rotational movement from the first drive gear 12 to the first sprocket 14, the first chain 16 is mechanically engaged with the first drive gear 12 and the first sprocket 14.

As seen in FIG. 11, similar to the positioning of the first drive gear 12, the second drive gear 13 is also positioned adjacent a bottom end 5 of the second lateral support arm 3. For the window pane 18 to respond to the rotational movement of the first drive gear 12, the second sprocket 15 is positioned adjacent a top end 4 of the second lateral support arm 3. To transfer the rotational movement from the second drive gear 13 to the second sprocket 15, the second chain 17 is mechanically engaged with the second drive gear 13 and the second sprocket 15.

Figure 5:
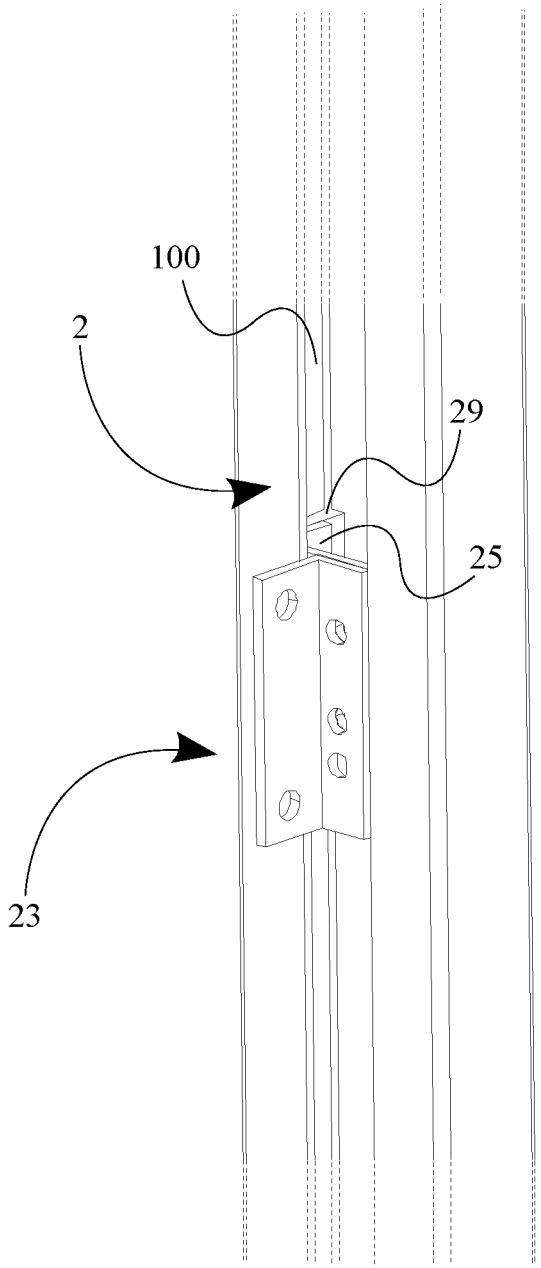
FIG. 5 is a perspective view of the first holding member positioned along the first lateral support arm.
Figure 6:
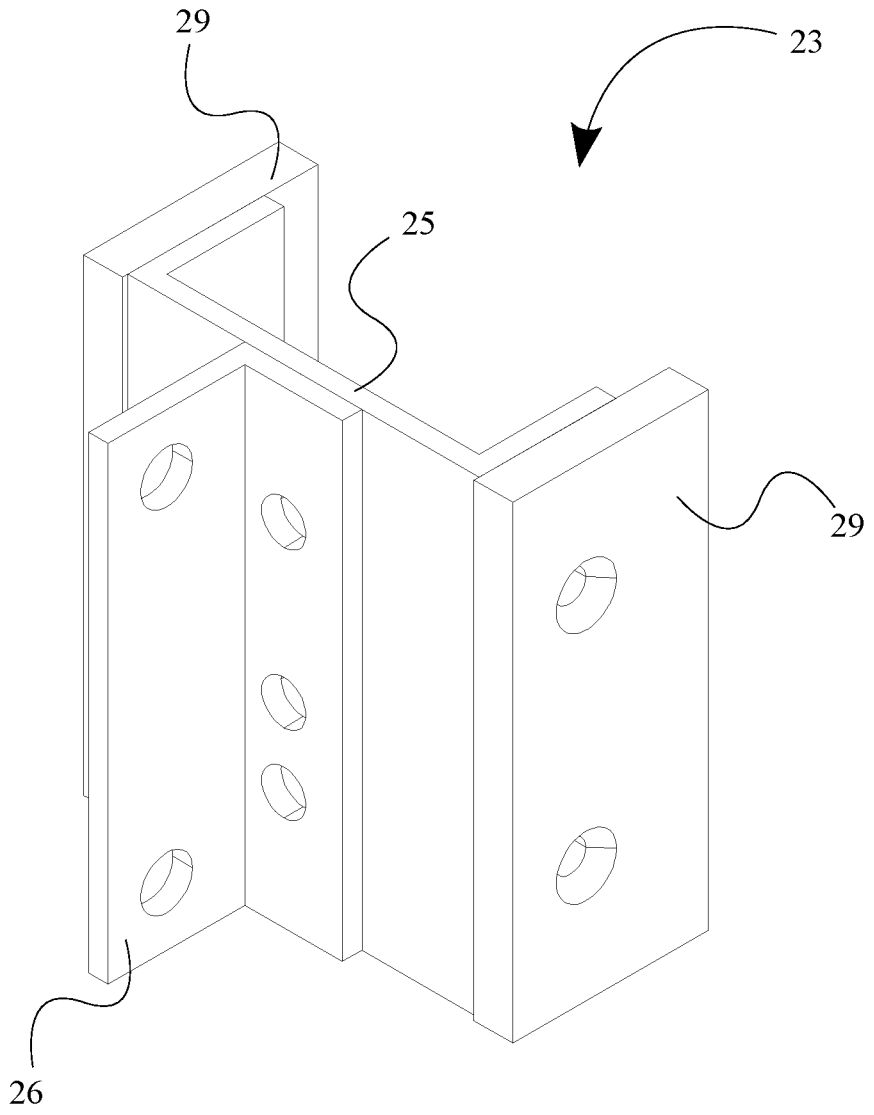
FIG. 6 is a perspective view of the first holding member.

As shown in FIG. 5 and FIG. 6, to maintain a steady hold at the first lateral edge 19, the present invention further comprises a first holding member 23 that comprises a sliding end 25 and a holding end 26. The sliding end 25 is slidably positioned along the first lateral support arm 2. The holding end 26, which is perpendicularly connected to the sliding end 25, perpendicularly extends outwards from the first lateral support arm 2. The holding end 26 is connected to the first lateral edge 19 of the window pane 19 so that the sliding end 25, the holding end 26, and the window pane 18 slide simultaneously along a vertical path.

Figure 7:
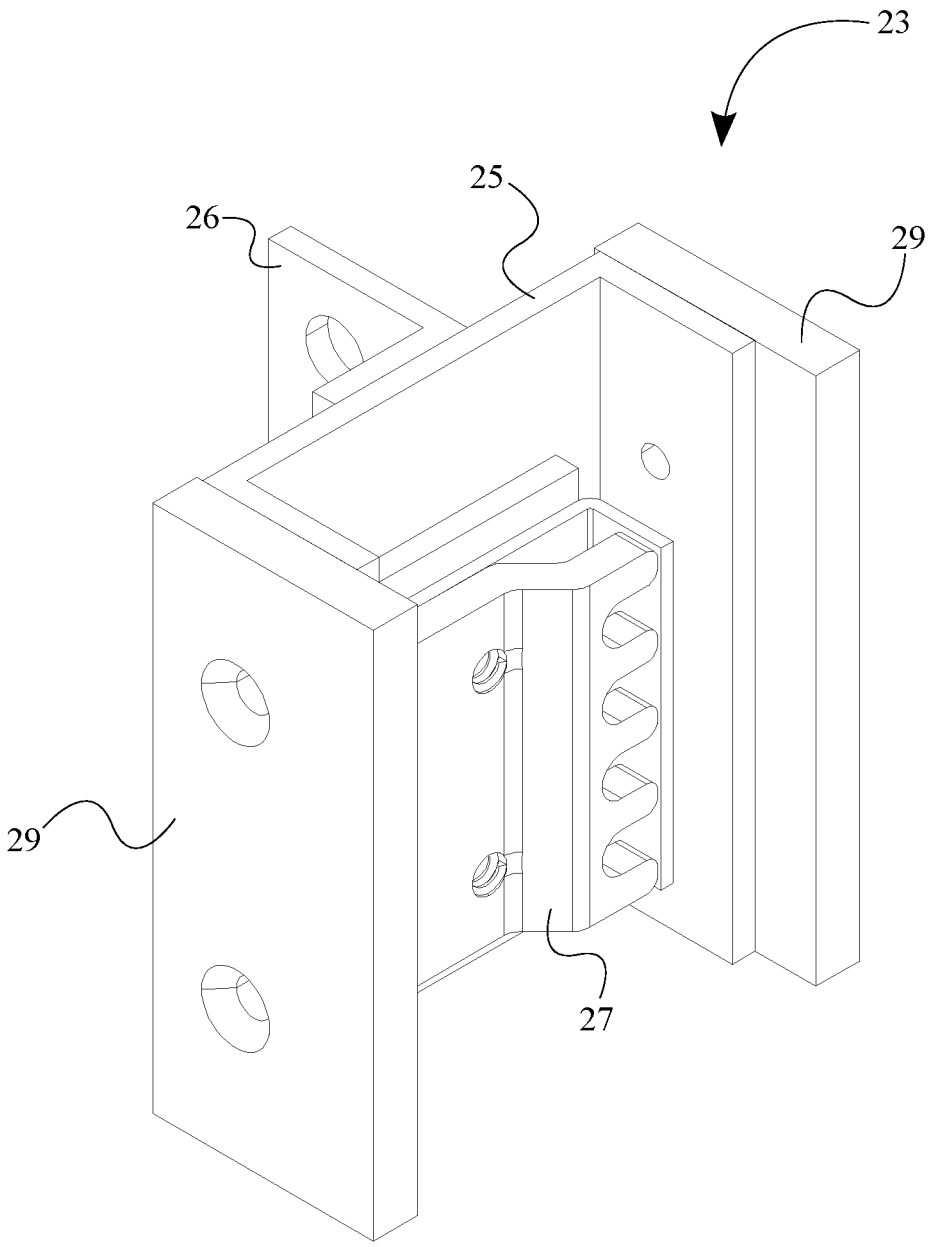
FIG. 7 is a rear perspective view of the first holding member.

As discussed earlier, the first chain 16 and the second chain 17 are used move the window pane 18 along the first lateral support arm 2 and the second lateral support arm 3. As seen in FIG. 7, to establish a connection with the first chain 16, the present invention comprises a first chain link-receiving section 27 that is connected to the sliding end 25 of the first holding member 23 opposite the holding end 26. More specifically, the first chain link-receiving section 27 is positioned adjacent the sliding end 25 opposite the holding end 26. A portion of the first chain 16 is attached to the first chain link-receiving section 27 so that the first lateral edge 19 moves simultaneously with the first chain 16. To prevent the sliding end 25 from contacting an internal surface 100 of the first lateral support arm 2 directly, which can affect the overall sliding capability of the sliding end 25, the present invention further comprises a sliding buffer barrier 29. As seen in FIG. 5, to ensure that the sliding end 25 moves along the first lateral support arm 2 smoothly, the sliding buffer barrier 29 is compressed between the sliding end 25 and an internal surface 100 of the first lateral support arm 2.

As seen in FIG. 9, to maintain a steady hold at the second lateral edge 20, the present invention further comprises a second holding member 24 that comprises a sliding end 25 and a holding end 26. The sliding end 25 of the second holding member 24 is slidably positioned along the second lateral support arm 3. The holding end 26, which is perpendicularly connected to the sliding end 25, perpendicularly extends outwards from the second lateral support arm 3. More specifically, the holding end 26 extends outwards from the second lateral support arm 3 and connects to the second lateral edge 20. As a result, when the sliding end 25 moves along a vertical path, the holding end 26, and the connected window pane 18 moves along the vertical path.

Figure 8:
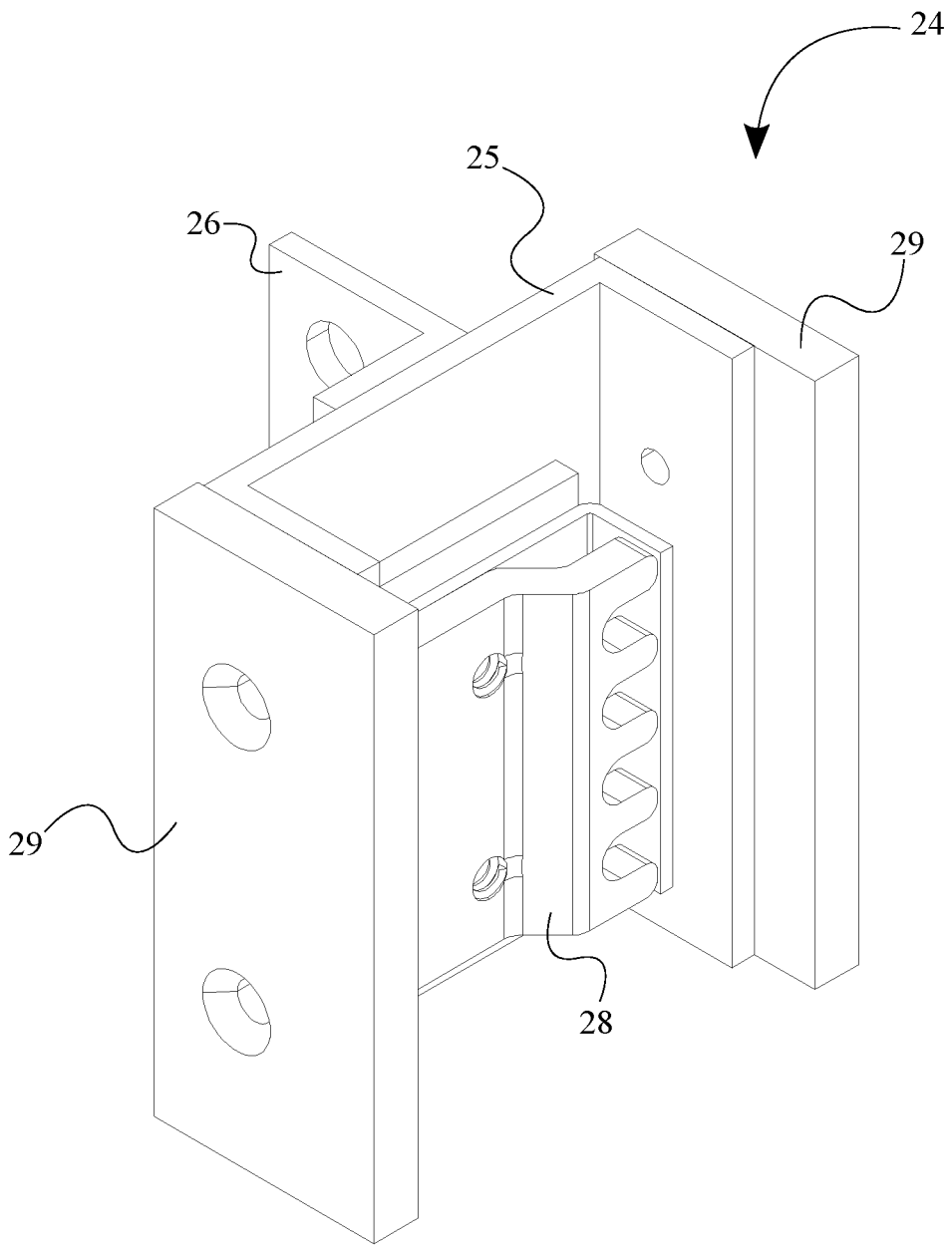
FIG. 8 is a rear perspective view of the second holding member.

As discussed earlier, the first chain 16 and the second chain 17 are used to move the window pane 18 along the first lateral support arm 2 and the second lateral support arm 3. As seen in FIG. 8, to establish a connection with the second chain 17 adjacent the second lateral edge 20, the present invention comprises a second chain link-receiving section 28. Since the sliding end 25 is positioned within the second lateral support arm 3 along with the second chain 17, the second chain link-receiving section 28 is connected to the sliding end 25 of the second holding member 24 opposite the holding end 26. More specifically, the second chain link-receiving section 28 is positioned opposite the holding end 26. To establish a connection between the sliding end 25 and the second chain 17, a portion of the second chain 17 is attached to the second chain link-receiving section 28. As seen in FIG. 9, a sliding buffer barrier 29 is compressed between the sliding end 25 and an internal surface 200 of the second lateral support arm 3 so that the sliding end 25 can move along the second lateral support arm 3 smoothly.

To support the overall weight, the shuttle frame 1 further comprises a base-support bar 30. The length of the base-support bar 30 depends on the overall length of the bottom edge 21 of the window pane 18. Therefore, the overall length of the base-support bar 30 can vary in different embodiments of the present invention. The base-support bar 30, which is positioned in between the first lateral support arm 2 and the second lateral support arm 3, is terminally connected adjacent the bottom end 5 of the first lateral support arm 2. Moreover, the base-support bar 30 is also terminally connected adjacent the bottom end 5 of the second lateral support arm 3 opposite the first lateral support arm 2. In the final configuration, the base-support bar 30 will be positioned in parallel and adjacent to the rotating shaft 8.

When the present invention is in use, the following process flow is generally followed. The user input is received at the gear motor 7. Based upon the user input the gear motor 7 rotates in a clockwise or counterclockwise direction. As a result, the first drive gear 12, the rotating shaft 8 connected to the first drive gear 12 at the first end 9, and the second drive gear 13 connected at the second end 11 rotate in a clockwise or counterclockwise direction. Since the first drive gear 12, the first sprocket 14, and the first chain 16 are mechanically engaged, the first chain 16 moves along the first drive gear 12 and the first sprocket 14. Simultaneously, the second chain 17 moves along the second drive gear 13 and the second sprocket 15. Since the window pane 18 is connected to the first chain 16 and the second chain 17, the vertical movement of the first chain 16 and the second chain 17 moves the connected window pane 18 in a vertical direction. More specifically, the upward movement of the window pane 18 and the downward movement of the window pane 18 is controlled through the sliding mechanism 6.

Although the invention has been explained in relation to its preferred embodiment, it is to be understood that many other possible modifications and variations can be made without departing from the spirit and scope of the invention as hereinafter claimed.

What is claimed is:

1. An electronically powered window comprises:
a shuttle frame;
a sliding mechanism;
a window pane;
a bottom edge support groove;
the shuttle frame comprises a first lateral support arm and a second lateral support arm;
the window pane comprises a first lateral edge, a second lateral edge, and a bottom edge;
the bottom edge support groove being positioned in between the first lateral support arm and the second lateral support arm;
the bottom edge support groove being positioned perpendicular to the first lateral support arm and the second lateral support arm;
the first lateral edge being terminally and perpendicularly connected to the bottom edge;
the second lateral edge being terminally and perpendicularly connected to the bottom edge opposite the first lateral edge along the bottom edge;
the first lateral edge being slidably positioned along the first lateral support arm with the sliding mechanism;
the second lateral edge being slidably positioned along the second lateral support arm with the sliding mechanism;
the bottom edge being positioned into the bottom edge support groove;
a first holding member;
the first holding member comprises a sliding end and a holding end;
the sliding end being slidably positioned along the first lateral support arm;
the holding end being perpendicularly connected to the sliding end;
the holding end perpendicularly extending outward from the first lateral support arm; and
the first lateral edge being connected to the holding end.

2. The electronically powered window as claimed in claim 1 further comprises:
the sliding mechanism comprises a gear motor, a rotating shaft, a first drive gear, a second drive gear, a first sprocket, a second sprocket, a first chain, and a second chain;
the rotating shaft comprises a first end, a shaft body, and a second end;
the shaft body extending from the first end to the second end;
the gear motor being mechanically coupled with the first drive gear;
the first drive gear being connected to the rotating shaft at the first end;
the second drive gear being connected to the rotating shaft at the second end;
the first drive gear being positioned adjacent a bottom end of the first lateral support arm;
the first sprocket being positioned adjacent a top end of the first lateral support arm opposite the first drive gear across a body of the first lateral support arm;
the first chain being mechanically engaged with the first drive gear and the first sprocket within the first lateral support arm;
the second drive gear being positioned adjacent a bottom end of the second lateral support arm;
the second sprocket being positioned adjacent a top end of the second lateral support arm opposite the second drive gear across a body of the second lateral support arm; and
the second chain being mechanically engaged with the second drive gear and the second sprocket within the second lateral support arm.

3. The electronically powered window as claimed in claim 1 further comprises:
a first chain link-receiving section;
the first chain link-receiving section being connected to the sliding end opposite the holding end; and
a portion of a first chain of the sliding mechanism being attached to the first chain link-receiving section.

4. The electronically powered window as claimed in claim 1 further comprises:
a sliding buffer barrier; and
the sliding buffer barrier being compressed between the sliding end and an internal surface of the first lateral support arm.

5. The electronically powered window as claimed in claim 1 further comprises:
a second holding member;
the second holding member comprises a sliding end and a holding end;
the sliding end being slidably positioned along the second lateral support arm;
the holding end being perpendicularly connected to the sliding end;
the holding end perpendicularly extending outward from the second lateral support arm; and
the second lateral edge being connected to the holding end.

6. The electronically powered window as claimed in claim 5 further comprises:
a second chain link-receiving section;
the second chain link-receiving section being connected to the sliding end opposite the holding end; and
a portion of a second chain of the sliding mechanism being attached to the second chain link-receiving section.

7. The electronically powered window as claimed in claim 5 further comprises:

a sliding buffer barrier; and the sliding buffer barrier being compressed between the sliding end and an internal surface of the second lateral support arm.

8. The electronically powered window as claimed in claim 1 further comprises:

the shuttle frame further comprises a base-support bar;

the base-support bar being positioned in between the first lateral support arm and the second lateral support arm;

the base-support bar being terminally connected adjacent a bottom end of the first lateral support arm;

the base-support bar being terminally connected to adjacent a bottom end of the second lateral support arm opposite the first lateral support arm; and the base-support bar being positioned in parallel and adjacent to a rotating shaft of the sliding mechanism.

9. The electronically powered window as claimed in claim 1 further comprises:

at least one bottom edge buffer barrier;

the at least one buffer barrier being positioned along the bottom edge; and the at least one bottom edge being compressed in between an internal surface of the bottom edge support groove and the bottom edge.

* * * * *